US010352167B2

(12) United States Patent
Zhang et al.

(10) Patent No.: US 10,352,167 B2
(45) Date of Patent: Jul. 16, 2019

(54) PROCESS METHOD FOR WITHDRAWING AND RECOVERING MECHANICAL CONSTANT-RESISTANCE SINGLE PROP

(71) Applicant: China University of Mining and Technology, Jiangsu (CN)

(72) Inventors: Jixiong Zhang, Jiangsu (CN); Nan Zhou, Jiangsu (CN); Wenyue Qi, Jiangsu (CN); Qiang Zhang, Jiangsu (CN); Meng Li, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 0 days.

(21) Appl. No.: 16/084,971

(22) PCT Filed: Dec. 1, 2016

(86) PCT No.: PCT/CN2016/108289
§ 371 (c)(1),
(2) Date: Sep. 13, 2018

(87) PCT Pub. No.: WO2018/082149
PCT Pub. Date: May 11, 2018

(65) Prior Publication Data

US 2019/0085691 A1 Mar. 21, 2019

(30) Foreign Application Priority Data

Nov. 3, 2016 (CN) ..... 2016 1 0953089

(51) Int. Cl.
*F16M 11/00* (2006.01)
*E21D 15/60* (2006.01)
*E21D 15/20* (2006.01)

(52) U.S. Cl.
CPC ..... *E21D 15/60* (2013.01); *E21D 15/20* (2013.01)

(58) Field of Classification Search
CPC ..... E21D 15/60; E21D 15/44; E21D 15/20
See application file for complete search history.

(56) References Cited

U.S. PATENT DOCUMENTS 1,895,053 A 1/1933 Staley
2,621,631 A * 12/1952 Loebbe ..... E21D 15/45 254/93 R (Continued)

FOREIGN PATENT DOCUMENTS

CN 201209453 3/2009
CN 201225159 4/2009

(Continued)

OTHER PUBLICATIONS

"International Search Report (Form PCT/ISA/210)", dated Aug. 7, 2017, with English translation thereof, pp. 1-4.

*Primary Examiner* — Amy J. Sterling
(74) *Attorney, Agent, or Firm* — JCIPRNET

(57) ABSTRACT

The present invention discloses a process method for withdrawing and recovering a mechanical constant-resistance single prop, specific steps involving: detecting a working resistance and a degree of deformation of a mechanical constant-resistance single prop, releasing lug clamp bolts of a recoverable base, knocking a lower portion of a cylinder body of the mechanical constant-resistance single prop to disengage the mechanical constant-resistance single prop from the recoverable base, and dismantling the mechanical constant-resistance single prop. Parts are classified and recovered based on degree of deformation thereof. By means of the foregoing method, a process of withdrawing and recovering a mechanical constant-resistance single prop is standardized, simple and fast disengagement of the mechanical constant-resistance single prop is achieved, and parts that can still be used can be sufficiently recovered and (Continued)

reused, thereby achieving the objectives of saving energy and reducing costs.

5 Claims, 3 Drawing Sheets

(56) References Cited

U.S. PATENT DOCUMENTS 2,816,728 A * 12/1957 Lobbe ..... E21D 15/002
137/614.05
3,191,506 A * 6/1965 Ledeen ..... E21D 15/44
91/1

FOREIGN PATENT DOCUMENTS

| | | |
|---|---|---|
| CN | 202100265 | 1/2012 |
| CN | 102562100 | 7/2012 |
| CN | 102966363 | 3/2013 |
| CN | 104879145 | 9/2015 |

* cited by examiner

PROCESS METHOD FOR WITHDRAWING AND RECOVERING MECHANICAL CONSTANT-RESISTANCE SINGLE PROP

CROSS-REFERENCE TO RELATED APPLICATION

This application is a 371 of international application of PCT application serial no. PCT/CN2016/108289, filed on Dec. 1, 2016, which claims the priority benefit of China application no. 201610953089.2, filed on Nov. 3, 2016. The entirety of each of the above-mentioned patent applications is hereby incorporated by reference herein and made a part of this specification.

BACKGROUND

Technical Field

The present invention relates to the technical field of roadway support for coal mines and metal mines, and in particularly, to a process method for withdrawing and recovering a mechanical constant-resistance single prop.

Description of Related Art

As mechanical constant-resistance single props become popular, orderly replacement of a large quantity of wood cribs in advanced supporting areas in underground stopping roadways are implemented.

After the use of a mechanical constant-resistance single prop is finished, when a supporting effect is desirable and roadway deformation is not severe, in the mechanical constant-resistance single prop, a steel ball retainer is damaged, a cylinder body and a rod body are deformed to a certain extent, a limiting cover, a top tray, and a base are slightly damaged but are basically kept intact. However, none or only a few of mechanical constant-resistance single props on site are withdrawn and recovered. As a result, a lot of raw materials are wasted, a working progress is slowed, and the production efficiency is reduced.

For the foregoing actual problems of withdrawing and recovering mechanical constant-resistance single props on site, standardization of a process of withdrawing and recovering mechanical constant-resistance single props is an effective manner of implementing simple, fast, and efficient recovering and reuse of mechanical constant-resistance single props and saving materials.

SUMMARY

An objective of the present invention is to provide a process method for withdrawing and recovering a mechanical constant-resistance single prop, so as to resolve the foregoing problem that exists in the prior art and recover and reuse mechanical constant-resistance single props in a simple, fast, and efficient manner.

To achieve the foregoing objective, the present invention provides the following solution: the present application provides a process method for withdrawing and recovering a mechanical constant-resistance single prop, including the following steps:

(1) detecting a working resistance of the mechanical constant-resistance single prop, measuring a degree of deformation of the mechanical constant-resistance single prop, and performing recovery after it is determined that it is safe to withdraw the mechanical constant-resistance single prop;

(2) holding the mechanical constant-resistance single prop steadily, and releasing lug clamp bolts;

(3) inserting a steel drill rod in a central joint of a base, and prying out a wedge-shaped movable block in the base;

(4) knocking a lower portion of a cylinder body of the mechanical constant-resistance single prop to disengage the mechanical constant-resistance single prop from the base, so that a prop body of the mechanical constant-resistance single prop sliding out of the base;

(5) releasing a bolt on a top tray at the top of the mechanical constant-resistance single prop, removing the top tray, releasing bolts on a limiting cover, removing the limiting cover, pulling out a rod body from the cylinder body, and removing a steel ball retainer;

(6) classifying and recovering the top tray and the base according to degree of damage; and classifying and recovering the rod body and the cylinder body according to degree of deformation;

(7) rematching the reusable rod body and cylinder body, sleeving a new steel ball retainer on the rod body, inserting the rod body in the cylinder body, pressing the steel ball retainer tightly to achieve a sliding-surface self-lock, setting the height of the mechanical constant-resistance single prop, tightening the bolts on the limiting cover, thereby reassembling the mechanical constant-resistance single prop;

(8) performing a sample inspection on mechanical constant-resistance single props assembled using recovered parts, detecting a maximum working resistance by compression test of single props in a laboratory, and putting the mechanical constant-resistance single props passing the sample inspection to use.

Preferably, in step (1), the working resistance of the mechanical constant-resistance single prop is detected by using a working resistance monitor of the mechanical constant-resistance single prop, and the mechanical constant-resistance single prop is recycled when the measured working resistance thereof is less than a safety value of 450 kN.

Preferably, in step (1), the degree of deformation of the mechanical constant-resistance single prop is measured by using a cross measurement method, the degree of deformation refers to a bending degree of the mechanical constant-resistance single prop, and during recovering, the rod body with a deformation less than 10 mm is deemed reusable, and the cylinder body with a deformation less than 10 mm is deemed reusable.

Preferably, in step (6), a standard by which classifying and recovering the top tray and the base according to degree of damage is: a deformation of a through hole at a bolt connection between the top tray and the rod body and a deformation of a through hole at a connection between the base and the lug clamp bolts are respectively used as criteria for recovering, recover and use the top tray and the base when the deformations of the through holes are less than 15%, and reforge and use the top tray and the base when the deformations of the through holes are greater than 15%; and a standard by which classifying and recovering the rod body and the cylinder body according to the degree of deformation is: directly recover and use the rod body and the cylinder body when deformations of the rod body and the cylinder body are between 0 and 10 mm, reforge and use the rod body and the cylinder body if the deformations of the rod body and the cylinder body exceed 10 mm.

Preferably, in step (8), during the compression test of a recovered mechanical constant-resistance single prop in the laboratory, the tested maximum working resistance is between 450 kN and 500 kN.

Compared with the prior art, the present invention has achieved the following technical effects:

The present invention discloses a process method for withdrawing and recovering a mechanical constant-resistance single prop, and provides a process method for withdrawing and recovering a mechanical constant-resistance single prop. The process method for withdrawing and recovering is convenient and fast to implement, efficient, and has wide practicability and reference significance in the recovering and use of mechanical constant-resistance single props.

BRIEF DESCRIPTION OF THE DRAWINGS

To describe the technical solutions in the embodiments of the present invention or in the prior art more clearly, the following briefly introduces the accompanying drawings required for describing the embodiments. Apparently, the accompanying drawings in the following description show some embodiments of the present invention, and persons of ordinary skill in the art may still derive other drawings from these accompanying drawings without creative efforts.

1, prop body; 2, base; 3, cylinder body; 4, top tray; 5, rod body; 6, steel ball retainer; 7, limiting cover; 8, limiting cover bolt; 9, top tray bolt; 10, first lug clamp; 11, lug clamp bolt; 12, wedge-shaped movable block; 13, central joint; 14, conical surface of cylinder body; 15, base floor; 16, wedge-shaped fixed block; 17, nut; 18, conical surface; 19, cylindrical hole; 20, second lug clamp; and 21, prop base.

DESCRIPTION OF THE EMBODIMENTS

The technical solutions according to the embodiments of the present invention are clearly and thoroughly described with reference to the accompanying drawings in the embodiments of the present invention. The described embodiments are merely exemplary ones, and by no means encompass all the embodiments of the present invention. All other embodiments derived by persons of ordinary skill in the art based on the embodiments of the present invention without any creative efforts shall fall within the scope of the present invention.

To make the objectives, features, and advantages of the present invention more clearly, the present invention is further described below in detail with reference to the accompanying drawings and the detailed description of embodiments.

Figure 1:
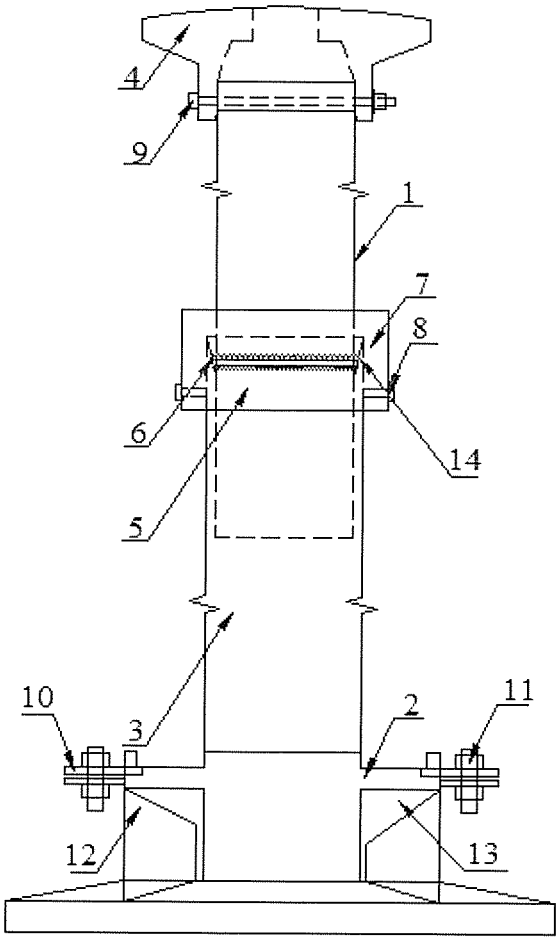
FIG. 1 is a schematic structural diagram of a mechanical constant-resistance single prop according to the present invention.
Figure 2:
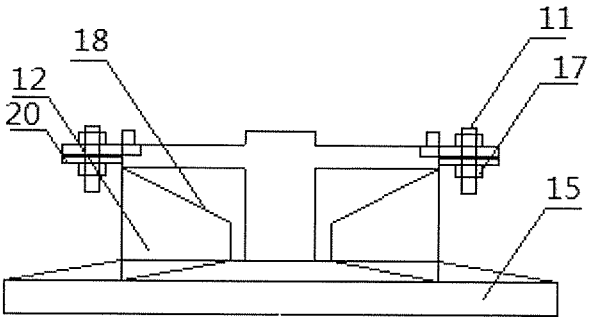
FIG. 2 is a schematic diagram of a base structure from a perspective according to the present invention.
Figure 3:
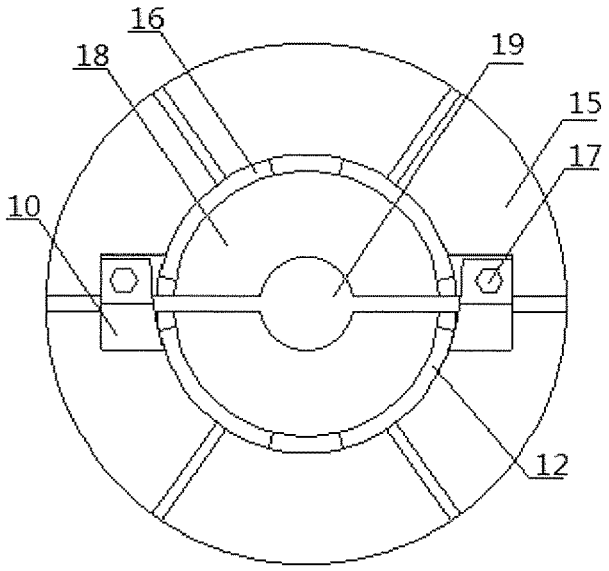
FIG. 3 is a schematic diagram of a base structure from another perspective according to the present invention.
Figure 4:
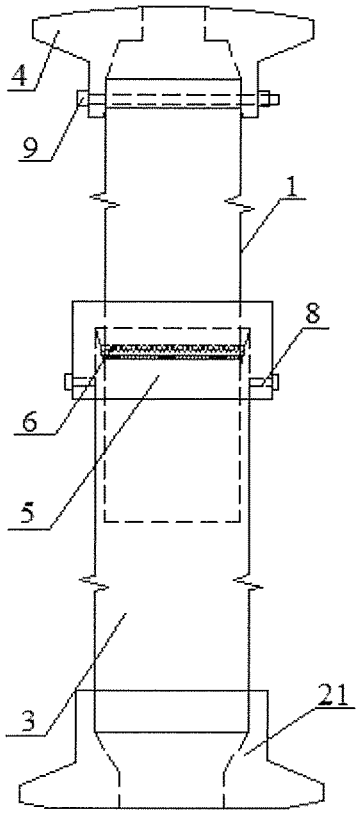
FIG. 4 is a schematic structural diagram of a prop body of a mechanical constant-resistance single prop according to the present invention.
Figure 5:
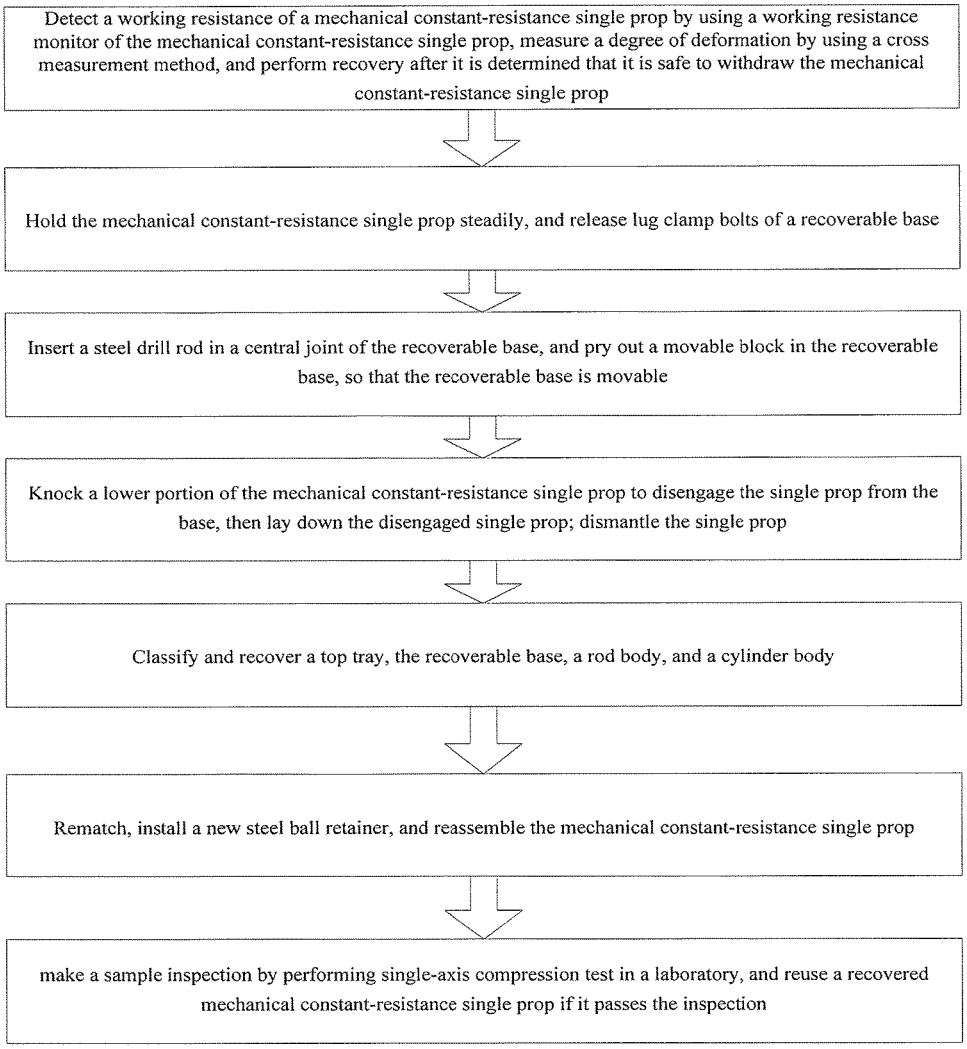
FIG. 5 is a schematic flowchart of a process method for withdrawing and recovering a mechanical constant-resistance single prop according to the present invention.

The process method for withdrawing and recovering a mechanical constant-resistance single prop in the present invention is performed for a mechanical constant-resistance single prop shown in FIG. 1. The mechanical constant-resistance single prop in FIG. 1 includes a prop body 1 and a base 2.

The base 2 includes a base floor 15 and two wedge-shaped supporting blocks. One wedge-shaped supporting block is welded on the base floor 15 as a wedge-shaped fixed block 16, and the other wedge-shaped supporting block is used as a wedge-shaped movable block 12 and connected to the wedge-shaped fixed block 16 through lug clamp bolts 11 and nuts.

Both ends of the wedge-shaped fixed block 16 and the wedge-shaped movable block 12 are provided with a lug clamp. First lug clamps 10 at the two ends of the wedge-shaped fixed block and second lug clamps 20 at the two ends of the wedge-shaped movable block have different heights. The wedge-shaped fixed block 16 and the wedge-shaped movable block 12 are symmetrically disposed. The first lug clamps 10 at the two ends of the wedge-shaped fixed block 16 and the second lug clamps 20 at the two ends of the wedge-shaped movable block 12 overlap, and are connected through the lug clamp bolts 11 and the nuts at the lug clamps.

Upper-end surfaces of the wedge-shaped blocks have a semi-conical surface. A semi-circular notch is provided on a side, near another wedge-shaped block, of each semi-conical surface. The wedge-shaped fixed block 16 and the wedge-shaped movable block 12 are symmetrically disposed and connected to form a combined body. A cylindrical hole 19 is provided at the center of the combined body. An upper-end surface of the combined body is a conical surface 18.

The prop body of the mechanical constant-resistance single prop includes a rod body 5, a cylinder body 3, a prop base 21, a top tray 4, and a steel ball retainer 6. The cylinder body 3 is a hollow prop body. A conical surface of cylinder body 14 is disposed at the top of an inner wall of the cylinder body 3. The steel ball retainer 6 is sleeved on one end of the rod body 5, and the end of the rod body 5 on which the steel ball retainer 6 is sleeved is placed in the hollow prop body of the cylinder body, so that the steel ball retainer 6 is located between the conical surface of cylinder body 14 and the rod body 5. A limiting cover 7 for preventing steel balls from going out of the cylinder body 5 is disposed outside the conical surface of cylinder body 14. The top tray 4 is disposed at an end of the rod body 5 on which the steel ball retainer 6 is not sleeved. The bottom end of the cylinder body 5 is disposed inside a groove of the prop base 21.

Two steel ball retainers 6 are disposed. The radius of the upper steel ball retainer is greater than that of the lower steel ball retainer.

Three limiting cover bolts 8 connected to the cylinder body 3 are disposed on the limiting cover 7.

The rod body 5 is connected to the top tray 4 through a top tray bolt 9.

The top tray 4 has a disc shape, and an upper surface of the top tray 4 is an arc-shaped surface.

The prop base 21 has a disc shape, and a lower surface of the prop base 21 is a horizontal plane.

The present application provides a process method for withdrawing and recovering a mechanical constant-resistance single prop, specific steps being as follows:

(1) detecting a working resistance of a mechanical constant-resistance single prop, measuring a degree of deformation of the mechanical constant-resistance single prop, and performing recovery after it is determined that it is safe to withdraw the mechanical constant-resistance single prop;

(2) holding the mechanical constant-resistance single prop steadily, and releasing the lug clamp bolts 11;

(3) inserting a steel drill rod in a central joint of a base 13, and prying out a wedge-shaped movable block 12 in the base 2;

(4) knocking a lower portion of the cylinder body 3 of the mechanical constant-resistance single prop to disengage the mechanical constant-resistance single prop from the base 2, so that the mechanical constant-resistance single prop sliding out from the base 2;

(5) releasing a top tray bolt 9 on the top of the mechanical constant-resistance single prop, removing a top tray 4, releasing bolts 8 on a limiting cover 7, removing the limiting cover 7, pulling out a rod body 5 from the cylinder body 3, and removing a steel ball retainer 6;

(6) classifying and recovering the top tray 4 and the base 2 according to degree of damage; and classifying and recovering the rod body 5 and the cylinder body 3 according to degree of deformation;

(7) rematching the reusable rod body 5 and cylinder body 3, sleeving a new steel ball retainer 6 on the rod body 5, inserting the rod body 5 in the cylinder body 3, pressing the steel ball retainer 6 tightly to achieve a sliding-surface self-lock, setting the height of the mechanical constant-resistance single prop, tightening the bolts on the limiting cover 8, thereby reassembling the mechanical constant-resistance single prop;

(8) performing a sample inspection on mechanical constant-resistance single props assembled using recovered parts, detecting a maximum working resistance by compression test of single props in a laboratory, and putting the mechanical constant-resistance single props passing the sample inspection to use.

In step (1), the working resistance of the mechanical constant-resistance single prop is detected by using a working resistance monitor of the mechanical constant-resistance single prop, and the mechanical constant-resistance single prop is recycled when the measured working resistance thereof is less than a safety value of 450 kN.

In step (1), the degree of deformation of the mechanical constant-resistance single prop is measured by using a cross measurement method, the degree of deformation refers to a bending degree of the mechanical constant-resistance single prop, and during recovering, the rod body 5 with a deformation less than 10 mm is deemed reusable, and the cylinder body 3 with a deformation less than 10 mm is deemed reusable.

In step (6), a standard by which classifying and recovering the top tray 4 and the base 2 according to degree of damage is: a deformation of a through hole at a bolt connection between the top tray 4 and the rod body 5 and a deformation of a through hole at a connection between the base 2 and the lug clamp bolts 11 are respectively used as criteria for recovering, recover and use the top tray and the base when the deformations of the through holes are less than 15%, and reforge and use the top tray and the base when the deformations of the through holes are greater than 15%; and a standard by which classifying and recovering the rod body 5 and the cylinder body 3 according to the degree of deformation is: directly recover and use the rod body 5 and the cylinder body 3 when deformations of the rod body 5 and the cylinder body 3 are between 0 and 10 mm, and reforge and use the rod body 5 and the cylinder body 3 if the deformations of the rod body 5 and the cylinder body 3 exceed 10 mm.

In step (8), during the compression test of a recovered mechanical constant-resistance single prop in the laboratory, the tested maximum working resistance is between 450 kN and 500 kN.

The mechanical constant-resistance single props reassembled using recoverable parts have a pass rate greater than 90% in the sample inspection.

In conclusion, a process of withdrawing a mechanical constant-resistance single prop is performed sequentially as follows: detecting a working resistance and a degree of deformation of a mechanical constant-resistance single prop, releasing lug clamp bolts of a recoverable base 11, knocking a lower portion of the cylinder body 3 of the mechanical constant-resistance single prop to disengage the mechanical constant-resistance single prop from the recoverable base 2, and dismantling the mechanical constant-resistance single prop.

By means of the foregoing method, a process of withdrawing and recovering a mechanical constant-resistance single prop is standardized, simple and fast disengagement of the mechanical constant-resistance single prop is implemented, and parts that can still be used can be sufficiently recovered and reused, thereby achieving the objective of saving energy and reducing costs.

Although the principle and implementation manners of the present invention are described by using specific examples in the invention, descriptions of the embodiments are merely intended to help understand the methods and core idea of the present invention. Meanwhile, variations may be made to the specific implementation and application by persons of ordinary skill in the art according to the idea of the present invention. Therefore, the content of this specification shall not be construed as a limitation to the present invention.

What is claimed is:

1. A process method for withdrawing and recovering a mechanical constant-resistance single prop, comprising the following steps:

(1) detecting a working resistance of the mechanical constant-resistance single prop, measuring a degree of deformation of the mechanical constant-resistance single prop, and performing recovery after it is determined that it is safe to withdraw the mechanical constant-resistance single prop;

(2) holding the mechanical constant-resistance single prop steadily, and releasing lug clamp bolts;

(3) inserting a steel drill rod in a central joint of a base, and prying out a wedge-shaped movable block in the base;

(4) knocking a lower portion of a cylinder body of the mechanical constant-resistance single prop to disengage the mechanical constant-resistance single prop from the base, so that the mechanical constant-resistance single prop sliding out of the base;

(5) releasing a top tray bolt on the top of the mechanical constant-resistance single prop, removing a top tray, releasing bolts on a limiting cover, removing the limiting cover, pulling out a rod body from the cylinder body, and removing a steel ball retainer;

(6) classifying and recovering the top tray and the base according to degree of damage; and classifying and recovering the rod body and the cylinder body according to degree of deformation;

(7) rematching the reusable rod body and cylinder body, sleeving a new steel ball retainer on the rod body, inserting the rod body in the cylinder body, pressing the steel ball retainer tightly to achieve a sliding-surface self-lock, setting the height of the mechanical constant-resistance single prop, tightening the bolts on the limiting cover, thereby reassembling the mechanical constant-resistance single prop;

(8) performing a sample inspection on mechanical constant-resistance single props assembled using recovered parts, detecting a maximum working resistance by compression test of single props in a laboratory, and putting the mechanical constant-resistance single props passing the sample inspection to use.

2. The process method for withdrawing and recovering the mechanical constant-resistance single prop according to claim 1, wherein the working resistance of the mechanical constant-resistance single prop is detected by using a working resistance monitor of the mechanical constant-resistance single prop, and the mechanical constant-resistance single prop is recycled when the measured working resistance thereof is less than a safety value of 450 kN.

3. The process method for withdrawing and recovering the mechanical constant-resistance single prop according to claim 1, wherein the degree of deformation of the mechanical constant-resistance single prop is measured by using a cross measurement method, the degree of deformation refers to a bending degree of the mechanical constant-resistance single prop, and during recovering, the rod body with a deformation less than 10 mm is deemed reusable, and the cylinder body with a deformation less than 10 mm is deemed reusable.

4. The process method for withdrawing and recovering the mechanical constant-resistance single prop according to claim 1, wherein a standard by which classifying and recovering the top tray and the base according to degree of damage is: a deformation of a through hole at a bolt connection between the top tray and the rod body and a deformation of a through hole at a connection between the base and the lug clamp bolts are respectively used as criteria for recovering, recover and use the top tray and the base when the deformations of the through holes are less than 15%, and reforge and use the top tray and the base when the deformations of the through holes are greater than 15%; and a standard by which classifying and recovering the rod body and the cylinder body according to the degree of deformation is: directly recover and use the rod body and the cylinder body when deformations of the rod body and the cylinder body are between 0 and 10 mm, and reforge and use the rod body and the cylinder body if the deformations of the rod body and the cylinder body exceed 10 mm.

5. The process method for withdrawing and recovering the mechanical constant-resistance single prop according to claim 1, wherein during the compression test of a recovered mechanical constant-resistance single prop in the laboratory, the tested maximum working resistance is between 450 kN and 500 kN.

* * * * *